United States Patent [19]

Smith

[11] 4,380,124

[45] Apr. 19, 1983

[54] DRAWING BOARD

[75] Inventor: Joseph Smith, Auckland, New Zealand

[73] Assignee: Colin Ward Rogers, Auckland, New Zealand; a part interest

[21] Appl. No.: 217,183

[22] Filed: Dec. 16, 1980

[30] Foreign Application Priority Data

Jan. 22, 1980 [NZ] New Zealand ..... 192655

[51] Int. Cl.[3] ..... B43L 13/14

[52] U.S. Cl. ..... 33/433

[58] Field of Search ..... 33/432, 433, 434

[56] References Cited

U.S. PATENT DOCUMENTS 2,412,194 12/1946 Andersen et al. ..... 33/433
2,876,547 3/1959 Spencer et al. ..... 33/433

FOREIGN PATENT DOCUMENTS 74469 7/1952 Denmark ..... 33/433
1087359 8/1960 Fed. Rep. of Germany ..... 33/432
438176 7/1948 Italy ..... 33/432
746331 3/1956 United Kingdom ..... 33/433

*Primary Examiner*—Harry N. Haroian
*Attorney, Agent, or Firm*—Young & Thompson

[57] ABSTRACT

A drawing board suitable for use in preparing perspective drawings is provided with a pair of arcuate guide surfaces facing towards one another and situated towards one side of the drawing board, with a recess or depression between the arcuate guide surfaces, so that a drawing instrument having projections capable of engaging the arcuate guide surfaces, can be readily moved from one arcuate guide surface to the other to enable the drawing instrument to point towards vanishing points on either side of the drawing board. The drawing board may have straight guide edges, as well as additional arcuate guide edges, one of which may be directed towards a central vanishing point. The multipurpose board can be used to produce various types of perspective drawings and seven vanishing points are shown.

9 Claims, 5 Drawing Figures

DRAWING BOARD

Figure 1:
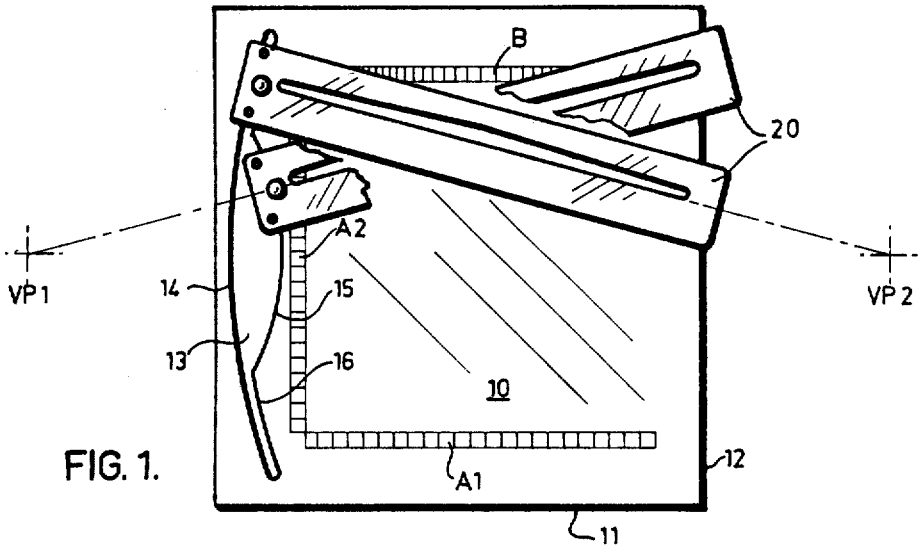

This invention relates to drawing boards, and has particular application to the production of perspective drawings.

In producing perspective drawings, it is necessary to draw lines which converge towards a vanishing point. The vanishing point may be within the frame of a picture, and thus within the confines of a drawing board, or may be outside the board depending upon the type of picture required. For example, in drawing the interior of a room, or drawing a landscape, the straight edges of objects in the picture are drawn as converging towards a central vanishing point. On the other hand, when drawing a close-up of an object, or drawing a building, the straight edges of the object are seen to converge towards different vanishing points outside the frame of the picture.

Many different attempts have been made to assist draughtsmen in drawing lines converging towards different vanishing points. U.S. Pat. Nos. 3,300,863 and 3,646,683 show different types of draughting machines having complicated moving parts, the inter-action of which assists the draughtsman in drawing lines converging towards different vanishing points. These however are complicated to manufacture and use. U.S. Pat. No. 2,412,194 describes a perspective drawing board having three concave arcuate edges acting as guide means for a special T-square, so that movement of the T-square along the arcuate guide edges will cause the T-square to point towards different vanishing points outside the drawing board. The concave nature of the guide edges, restricts the available working area of the board, and at the same time, the T-square must be moved bodily from one guide edge to another as the different lines are drawn. U.S. Pat. Nos. 2,876,547 and 3,492,727 describe the use of concave arcuate recesses within the boundaries of the drawing board to assist in guiding special T-squares to point towards vanishing points outside the edges of the drawing board. U.S. Pat. Nos. 1,969,758, 2,768,444 and 3,464,117 disclose the use of arcuate templates, which can be positioned on the drawing board, or in the case of U.S. Pat. No. 3,464,117, outside the drawing board, to assist in guiding special T-squares towards different vanishing points. These prior art arrangements require the user to bodily move his special T-square and/or the templates from one side of the board to the other, as different lines are to be drawn, and in some cases require the use of templates protruding above the surface of the board thereby interfering with the free use of the drawing surface.

It is an object of this invention to provide an improved drawing board suitable for use in the preparation of perspective drawings, or which will at least provide the public with a useful choice.

In one aspect, the invention provides a drawing board having a drawing surface and guide means for drawing instruments flush with or below the plane of the drawing surface, said guide means including a pair of arcs situated on one side of the board each arc defining a different vanishing point and a recess between the arcuate guide means to enable a drawing instrument positioned partly within said recess to be moved from one arc to the other to enable lines to be drawn towards the different vanishing points.

Figure 2:
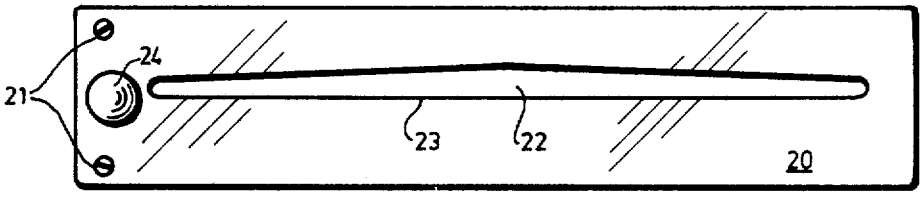
Figure 3:
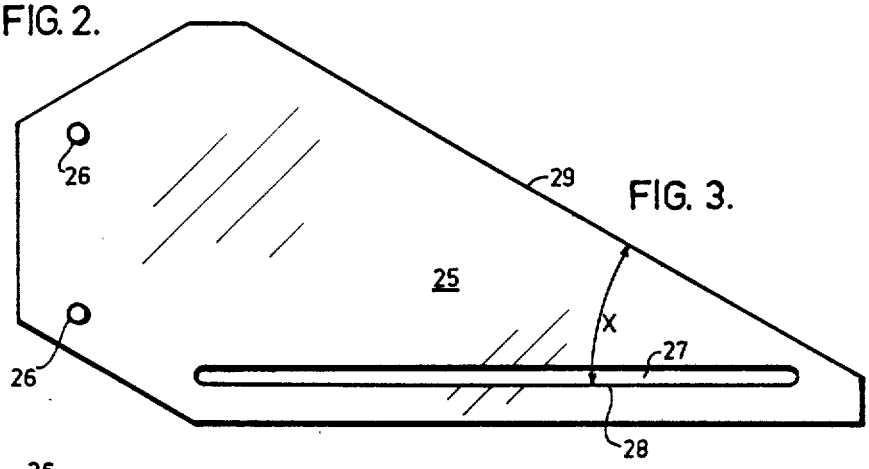
Figure 4:
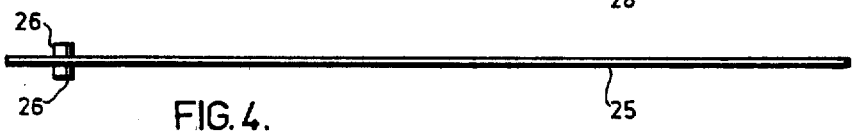
Figure 5:
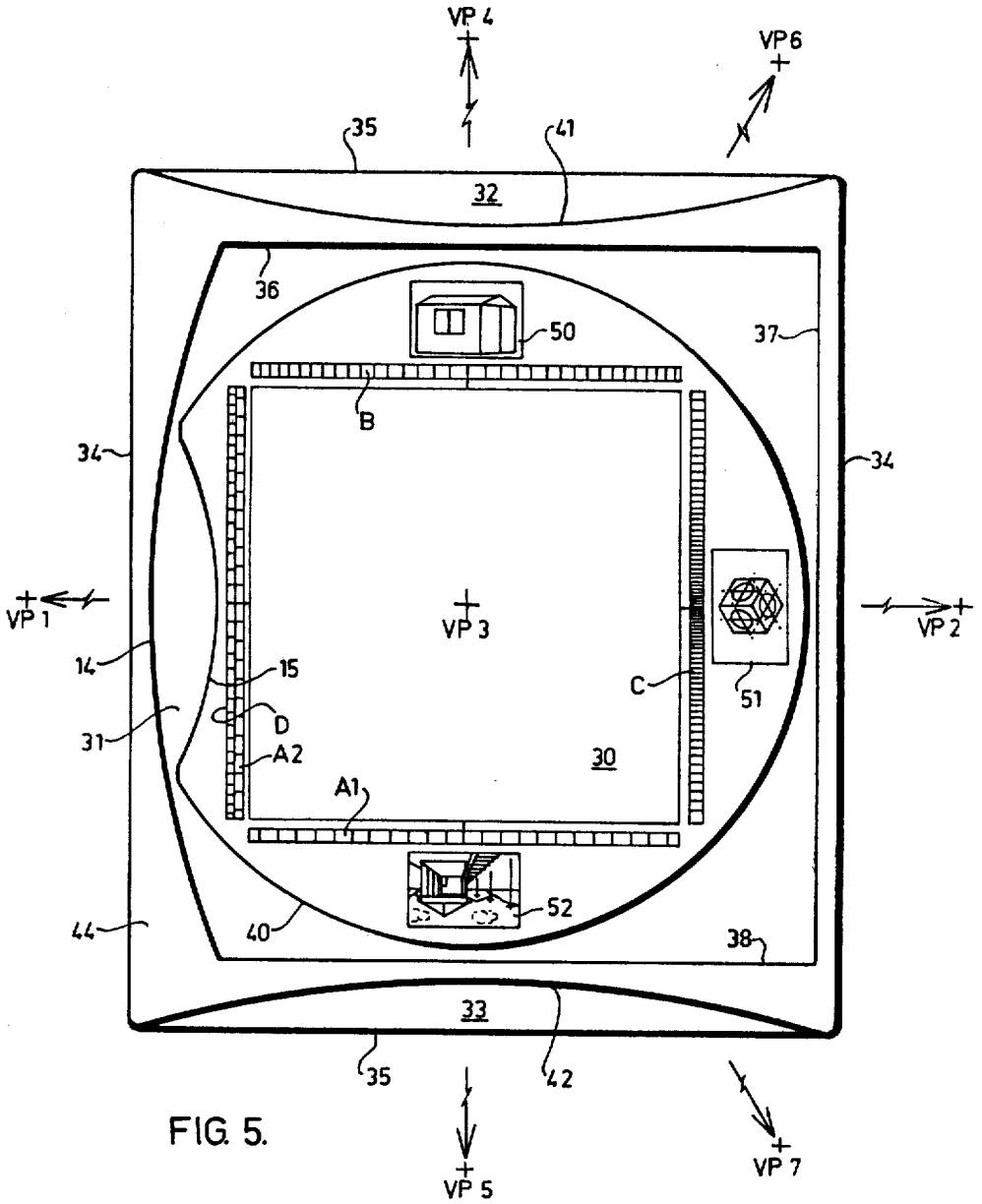

Other aspects of this invention, which should be considered in all its novel aspects, will become apparent from the following description, which is given by way of example only, with reference to the accompanying drawings, in which:

FIG. 1 illustrates a drawing board having two vanishing points outside the frame of the board FIG. 2 illustrates a drawing instrument for use in conjunction with drawing boards of this invention FIG. 3 illustrates a modified drawing instrument FIG. 4 illustrates the drawing instrument of FIG. 3 in side elevation FIG. 5 illustrates a composite drawing board having seven different vanishing points.

The drawing board of FIG. 1 has a drawing surface 10 bounded by straight edges 11 and 12, at right angles to one another.

A recessed area 13 is provided adjacent one edge of the board, and bounded by a pair of arcs 14, 15 facing towards one another. This recess 13 may be a depression in the surface of the board, or may be a slot or aperture passing through the board. Arc 14 has its centre at a vanishing point VP2 to the right of the drawing board. Arc 15 has a shorter radius of curvature, being centred on a vanishing point, VP1 to the left of the drawing board. The outer portions of the recess 13 are conveniently defined by arc 14, and a secondary arc 16 concentric with arc 14.

An elongate drawing instrument 20, has a pair of downward projections 21 adjacent one end thereof capable of fitting within the recess 13 of the board. A slot 22 is provided in the instrument, defining a guide edge 23 equi-distant between the projections 21. A handle or knob 24 may be provided on the upper face of the instrument.

By placing the drawing instrument on the drawing board with its projecting portions 21 fitted within the recess 13, movement of the drawing instrument 20 can be guided by the projecting portions 21 abutting against arc 14 thereby allowing the guide edge 23 to be used in drawing lines directed towards the vanishing point VP2. By simply moving the drawing instrument within the recess, the projecting portions 21 can be abutted against the arc 15, thereby allowing the guide edge 23 to be used to draw lines pointing towards the vanishing point VP1. By this means, the drawing board can be used to quickly and easily produce drawings having two vanishing points outside the frame of the board. Such drawings are frequently required for architectural purposes, when showing the outside of a building, with the two sides of the building appearing to converge toward two different vanishing points.

The drawing board may be provided with scales thereon. Conveniently, a pair of scales A1, A2 are provided at right angles to one another, each of these scales having equal intervals. In addition, a scale B is provided having intervals of unequal length diminishing towards the vanishing points VP1 and VP2. This scale can be considered to be made up of two separate scales starting from a point midway between VP1 and VP2, with the intervals then diminishing as they approach their respective vanishing point.

Scales A1 and A2 can be used to define the frame of the picture, and horizontal and vertical measurements can be taken from scales A1 and A2, marked onto the frame of the picture, and then projected towards the relevant vanishing points. Distances into the picture towards the vanishing point can be measured using scale B.

Turning now to FIG. 3, there is illustrated a modified drawing instrument, suitable for use with the drawing board of FIG. 5. This drawing instrument 25 has a pair of upwardly and downwardly projecting portions 26, a slot 27 defining a guide edge 28, and an external guide edge 29 at an angle to the guide edge 28. Preferably the angle x between the guide edges 28 and 29, is 30°, to enable the drawing instrument to be used in drawing "isometric-type" perspective drawings.

Turning now to FIG. 5, there is illustrated a composite drawing board having a drawing surface 30 surrounded by a recessed portion 31. A pair of additional recessed portions 32, 33 are provided adjacent opposite side edges of the board. Conveniently, the board is rectangular in outline, having straight side edges 34, 35 at right angles to one another. This enables the board to be reversed, and used as a plain drawing board having a flat reverse face (not shown). The drawing instruments 20 and 25 can also be used on the reverse face of the drawing board, in the manner of "T-squares."

The recessed area 31 is defined by arcs 14,15 having vanishing points VP1 and VP2 corresponding to those of FIG. 1. In addition, the recess 31 is defined by straight edges 36, 37, 38 at right angles to one another and parallel to the outside edges of the board. The inner edge of the recess 31 which is partly defined by the concave arc 15, is also defined by a convex arc 40 extending for more than one-half the circumference of a circle, centred on a central vanishing point VP3, preferably at the centre of the drawing board. Conveniently, vanishing points VP1, VP3 and VP2 are all situated on a common line.

The recessed portion 32 is defined by an arc 41 centred on vanishing point VP4. Similarly, arc 42 at the opposite edge of the board, is centred on vanishing point VP5.

The raised area 44 surrounding the recessed area 31 is preferably flush with the plane of the drawing surface 30 to provide additional support for drawing instruments spanning the recessed area 31.

Scales of equal interval, A1 and A2 are provided on the board, together with a scale B for use in conjunction with the guide edges 14 and 15. A scale C having intervals diminishing from the outside ends thereof towards the centre can be used in conjunction with the guide edge 40 for drawings having a central vanishing point VP3. An additional scale D having intervals diminishing from the centre thereof towards each end can be used in conjunction with guide edges 41 and 42 and is particularly suitable for use with "isometric-type" perspective drawings. Preferably, symbols 50, 51 and 52 are marked on the board to indicate the preferred orientation of the board when used for a particular type of perspective drawing. These symbols may also be coded in association with the various scales. For example, the board shown in FIG. 5 is oriented with the symbol 50 uppermost, and this shows that in this orientation, the board can be used in conjunction with guide edges 14 and 15 to produce an architectural type perspective drawing making use of the vanishing points VP1 and VP2. Additional vanishing points can be created by utilising an instrument such as that shown in FIG. 3.

By turning the board anti-clockwise through 90°, symbol 51 is then uppermost. In this orientation, "isometric-type" perspective drawings can be used utilising the guide edges 41 and 42, in conjunction with the instrument 25. By utilising the guide edge 29, this enables lines to be drawn towards the vanishing points VP6 and VP7 situated 30° above the vanishing points VP4 and VP5. The 30° angle of the guide edge 29 has been chosen as this enables the instrument to be used in conjunction with standard templates containing ellipses for isometric drawings. This enables a draughtsman to produce convincing perspective drawings incorporating circular shapes. Different angles x for the instrument 25 can be chosen depending upon the type of drawing and available templates for ellipses.

By rotating the drawing board through a further 90° anti-clockwise, symbol 52 will be uppermost. By using the arcuate guide edge 40, drawings having a central vanishing point VP3 can be produced. Examples of such drawings, are landscapes, and drawings of the interior of a room. These drawings can be readily produced by moving the instrument 20 around the guide edge 40, so that the edge 23 of the slot will always point towards the central vanishing point VP3. If horizontal or vertical lines are to be drawn, the instrument can be readily moved across the recess 31 until its projecting portions abut against the straight edges 36, 37 or 38. The scale C can be used in conjunction with the guide edge 40 to calculate distances into the picture towards the vanishing point VP3.

The drawing board of FIG. 1 or FIG. 5 can be produced of any convenient material, whether machined from a flat sheet, e.g. by routing of wood, plastics, or particle board, or by moulding into the required shape, e.g. by injection moulding or vacuum forming of a plastics material.

If desired, the pair of arcs 14, 15, may be provided in a portion of board as an attachment to an existing drawing board. Such an attachment could be fixed to the rear face of an existing drawing board, so that the surface of the attachment lies below, or flush with, the working surface of the existing board.

It will be noted that the arcuate guide means do not protrude above the plane of the drawing surface, and thus cannot interfere with the motion of a draughting machine if such is attached to the drawing board.

Finally, it will be appreciated that various alterations or modifications may be made to the foregoing without departing from the scope of this invention as exemplified by the following claims.

I claim:

1. A drawing board having a drawing surface and guide means for drawing instruments which guide means do not protrude above the plane of the drawing surface, said guide means including a pair of arcuate guide means of opposite curvature situated on one side of the board each arcuate guide means defining a different vanishing point with said vanishing points disposed on opposite sides of the center of the drawing surface, and a recess between the arcuate guide means to enable a drawing instrument positioned partly within said recess to be moved from one arcuate guide means to the other to enable lines to be drawn towards the different vanishing points on opposite sides of the center of the drawing surface, said arcuate guide means that is closest to the adjacent edge of the board being of larger radius, and being longer than the other said arcuate guide means.

2. A drawing board as claimed in claim 1, wherein the arcuate guide means face towards one another.

3. A drawing board as claimed in claim 2, and further including a central guide means consisting of an arc having its centre within the board and defining more than one-half a circle to enable a drawing instrument to be guided by the central guide means so as to point towards a central vanishing point.

4. A drawing board as claimed in claim 3, and further including a pair of additional arcuate guide means, each said additional arcuate guide means being adjacent a side edge of the board and defining a vanishing point outside the board.

5. A drawing board as claimed in claim 4, and further including a drawing instrument having a pair of projections adjacent one end of said instrument, and wherein the instrument has a pair of guide edges at an angle to one another.

6. A drawing board as claimed in claim 5, wherein the angle between the guide edges of the drawing instrument is 30°.

7. A drawing board as claimed in claim 6, and additional guide means on the drawing board comprising a pair of straight edges at right angles to one another.

8. A drawing board as claimed in claim 7, wherein scales are provided on the drawing board in association with each arcuate guide means, said scales including a pair of scales having equal intervals, said pair of scales being positioned at right angles to one another, and an additional scale having intervals diminishing towards a vanishing point associated with that arcuate guide means.

9. A drawing board as claimed in claim 1, said vanishing points being disposed beyond opposite side edges of the drawing board.

* * * * *